US005954333A

United States Patent [19]

Vilches Guerra

[11] Patent Number: 5,954,333

[45] **Date of Patent: *Sep. 21, 1999**

[54] DOUBLE CHESS ENLIGHTENING GAME

[76] Inventor: JoséMiguel Vilches Guerra, Salitre, 30 28012, Madrid, Spain

[ * ] Notice: This patent is subject to a terminal disclaimer.

[21] Appl. No.: 09/033,028

[22] Filed: Mar. 2, 1998

[51] Int. Cl.[6] ..... A63F 3/02

[52] U.S. Cl. ..... 273/261

[58] Field of Search ..... 273/260, 261, 273/262

[56] References Cited

U.S. PATENT DOCUMENTS

| | | | |
|---|---|---|---|
| 1,228,542 | 6/1917 | Durbin | 273/261 |
| 1,674,553 | 6/1928 | Templeton | 273/261 |
| 5,280,913 | 1/1994 | Sirk | 273/261 |
| 5,690,334 | 11/1997 | Duke | 273/261 |
| 5,692,754 | 12/1997 | Rostami | 273/261 |
| 5,735,523 | 4/1998 | Fioriglio | 273/261 |
| 5,749,583 | 5/1998 | Sadounichvili et al. | 273/261 |

FOREIGN PATENT DOCUMENTS

| | | | |
|---|---|---|---|
| 2201351 | 9/1988 | United Kingdom | 273/261 |

OTHER PUBLICATIONS

"Double Chess" by Julian S. Grant Hayward, 1916, The Chess Variant Pages.

"A Short History Of Chess" by A. Davidson, McKay, New York, 1981, pp. 102–107.

*Primary Examiner*—Benjamin H. Layno

*Attorney, Agent, or Firm*—Ostrolenk, Faber, Gerb & Soffen, LLP

[57] ABSTRACT

An enlightening double chess game with the chess board having double the number of columns of squares and a higher number of rows than the traditional chess board and double the number of chess pieces per player and including two additional players placed adjacent to king and queen with permissible moves that are a combination of moves from other pieces. Checkers may also be played on the board with a greater number of pieces. The method of using the board and pieces, i.e., the way some of the pieces move, is disclosed.

12 Claims, 6 Drawing Sheets

DOUBLE CHESS ENLIGHTENING GAME

BACKGROUND OF THE INVENTION

The present invention refers to a double chess or enlarged chess enlightening game, including a new board having a greater number of rows and columns than the original board. In particular, the board has double the number of columns, duplicating the conventional chess board. This affords room for double the number of chess pieces with a new space distribution. The game further creates two new game pieces affording greater dynamism and diversity to this game.

A traditional chess game set, for perhaps over 2000 years, has deployed 32 chess pieces, in two opposing sides of 16 pieces each confronting each other, movable over a game board having 64 squares arranged in 8 rows and 8 columns. Traditional rules have remained unchanged since the origin of this game.

Other chess like games have been created, derived from the original one, by fundamentally adding a higher number of players, with a layout in triangle and with access on all four sides in order to enable four players to simultaneously participate. But the game then loses its character as a game wherein two players are in direct confrontation.

There is also the well known "checkers" game which, on an identical 64 squares board, allows two players to play with 12 pieces each.

Given the old character of a chess game with the limitations imposed by its board having 64 squares at 8 squares per side, it has led to some stiffness in the evolution possibilities of the game, which is conditioned by the opening theory, which has become highly developed especially during this century. Thus, starting from a given knowledge level, success possibilities are reduced or practically disappear unless a series of moves are made, especially at the beginning of the game, according to the moves made by the opponent.

During the Middle Ages, the Spaniard Ruy López developed a concrete opening move, which is currently called the "Spanish opening", and which has been fully developed even beyond move 16th, without any other newly created eventual alternative. Such a situation exists with other chess game openings, like those named French, Caro Kahn, Slavonian, accepted or rejected Queen gambit, etc.

This situation has enabled development of machine or computing programs from these opening theories and half the game advantageously compete in front of the best specialists in this game's professional field.

During the year 1997, computer software was proven to be capable of defeating the present world chess champion in a six-round tournament. This ratifies the limitations of the traditional game as well as the progressive lack of alternatives and creativity in this game, as it allows programming the best possible move in every situation.

SUMMARY OF THE INVENTION

In order to cope with these limitations, the present invention provides a new game which is based on some characteristics of traditional chess, and creates a new and additional space, permits a huge diversity of moves, and produces new chess pieces. All of this makes this game-sport more exciting and creative and allows balancing the confrontation between players, thus propitiating once more the characteristics of intuition, mental nimbleness, shrewdness and analytic capacity which are supposedly linked with chess but which had lost their importance due to the study and memorization of renowned previous moves.

The present invention maintains the confrontation between only two players, doubles the number of chess pieces and consequently enlarges the board dimensions, multiplies the number of possible moves for every turn and considerably extends the game possibilities and alternatives at every move.

Other features and advantages of the present invention will become apparent from the following description of the invention which refers to the accompanying drawings.

DESCRIPTION OF A PREFERRED EMBODIMENT

Figure 1:
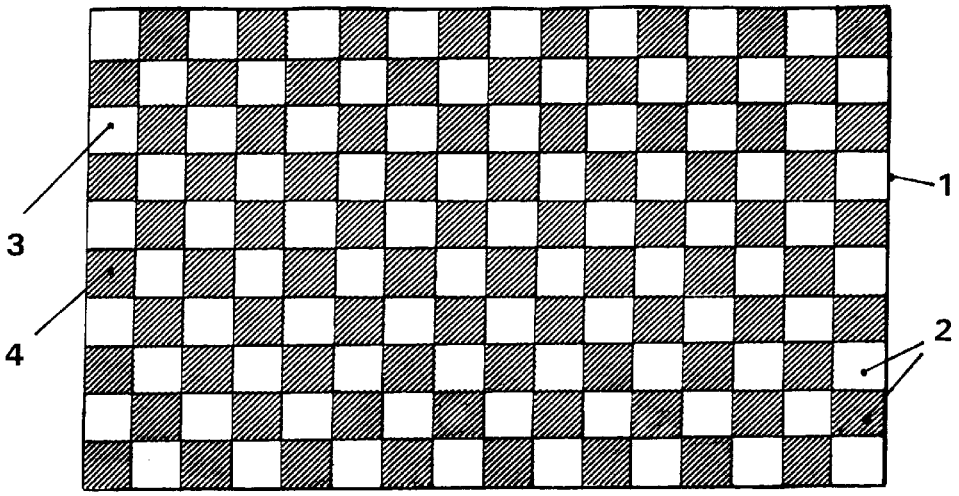
FIG. 1 shows a chess board according to the invention.

The game board 1 in FIG. 1 presents a rectangular layout, divided into a variable number of squares or chess 2, alternating in the mutually perpendicular or x and y directions in their color, typically, white 3 and black 4, in such a way that the lower left corner square or chess is always black.

In the preferred game board, the number of columns of squares in a horizontal array is 16, and the number of rows of squares in a vertical array is preferably 10. The number of rows may vary between 8 and 12. But an increase excessively complicates the game and extends its duration, with the loss of the nimbleness required for a table game to be pleasant and contending.

Figure 2:
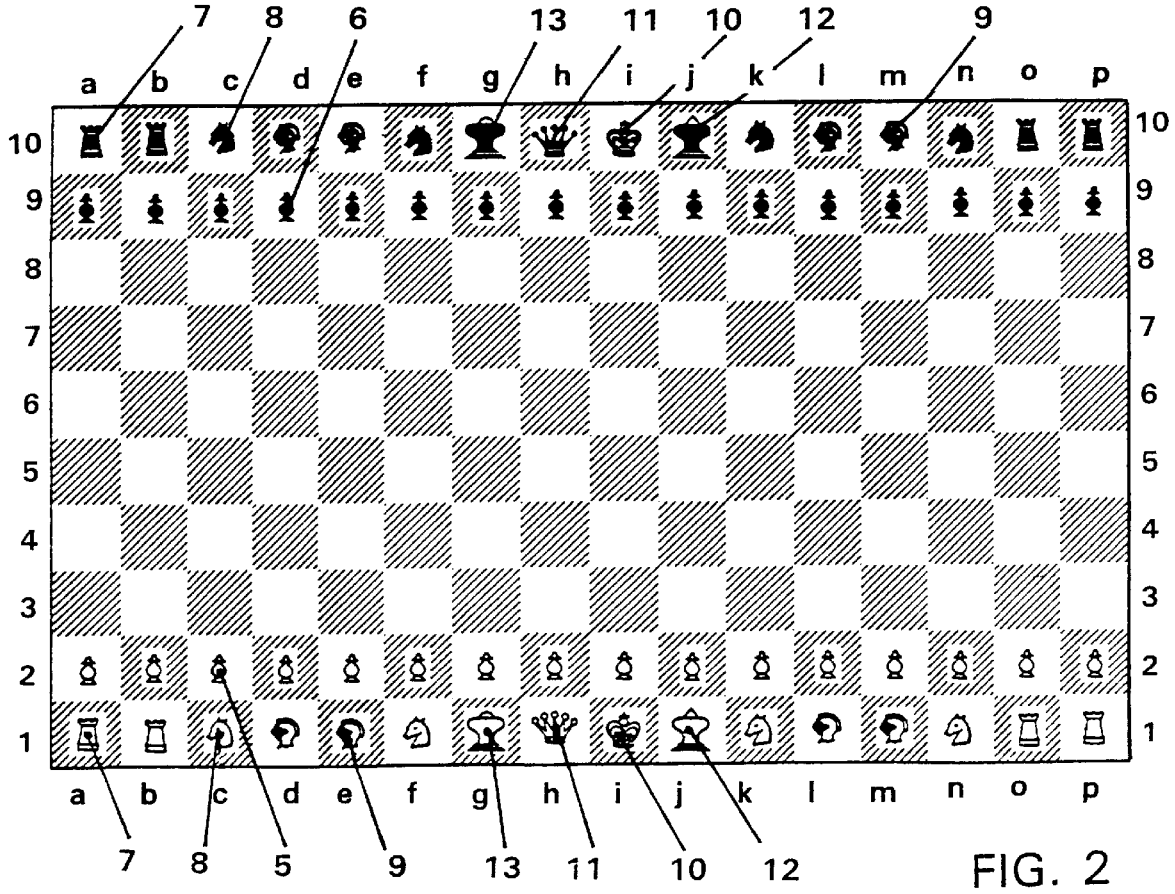
FIG. 2 shows the preferential layout of chess pieces on the board.
Figure 3:
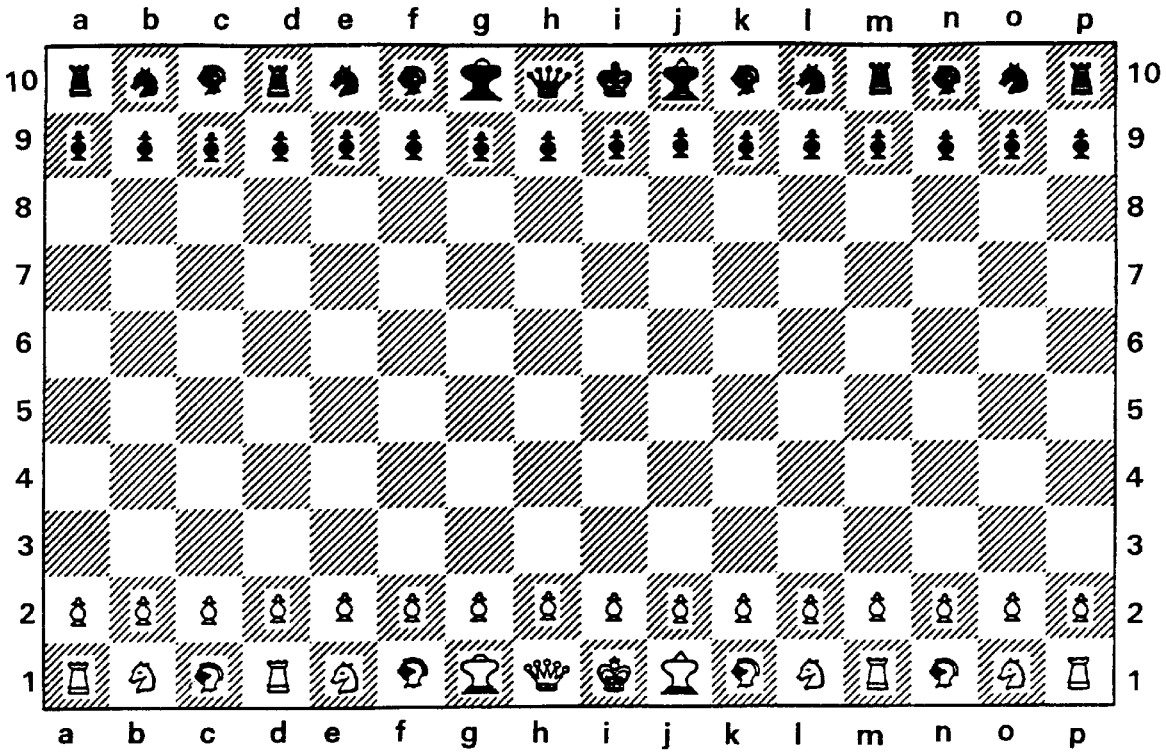
FIG. 3 shows an alternative distribution of chess pieces.

Chess pieces are placed opposite long sides of the board, in two rows on each side. The advanced or second rows are composed of 16 pawns. The white pawns 5 are placed on the second row, while the black pawns are placed on the row before last which, in the preferred embodiment is the 9th row. The first row receives the 16 white pieces according to a layout reproduced on either of FIGS. 2 or 3. The last row receives the equivalent 16 black pieces in a symmetrical and face to face distribution with the first row of white pieces. The colors of the two sets of chess pieces and of the alternate squares on the board are matters of choice, so long as the colors contrast, e.g. black and white.

Thus, at the two long edges of the board, there are placed the 4 rooks 7, the 4 knights 8 and the 4 bishops 9, reserving the four center squares of the row, for the king 10 and the queen 11, according to the traditional layout, and at their sides new pieces called "chancellor" 12 by the king, and "secretary" 13 by the queen.

Pawns 5 and 6 have opening moves, at the start of the game, which allow them to advance one, two or three squares or chess providing that such squares are free. This keeps the possibility to "take in passing" or en passant, as in the traditional chess, in the two first starting squares being threatened by the adversary pawn. The remaining moves of the pawns during the game are traditional vertically advancing one square at a time, taking the adversary piece in diagonal movement, and upon reaching the final square in a column being replaced by a piece having a higher strength, or queening.

The rooks 7, bishops 8, knights 9, as well as the dame or queen 11 and the king 10 maintain their movements and characteristics as in the traditional chess game, except for "castling". In the traditional chess game, there are two variations called "short castling" and "long castling", so called because castling is done with the rook located in the nearest corner or with the rook in the farthest one, respectively. In the present double chess game, this castling may be made in the preferred arrangement shown in FIG. 2, by moving the king up to the square contiguous to the first or second rook at either side of the king and then moving the corresponding rook to the opposite side of the king, even if the squares through which the king passes in its movement are threatened. In the alternative solution shown in FIG. 3, castling may be done twice on each side of every rook being on the same side in two independent moves and although the squares through which the king will pass in its movement are threatened, but in no case when either the king 10 or the rook with which it castles has been moved in previous turns.

This possibility of doing castlings on both sides, even if the intermediate squares are threatened, introduces a higher richness of movements and alternatives in the game development and is due to the higher vulnerability of the chess or squares in the relevant first rank in every side.

The main novelty as regards chess pieces is, as stated above, the addition of a "chancellor" and a "secretary" to each player's pieces.

The "chancellor" 12 is initially placed at the right hand side of the king, in the same column as and facing the opposite side "chancellor". The "chancellor" may move and take other pieces in all directions, like the traditional chess queen, or it may move and take pieces like the knight does in the historical game. In this way, the "chancellor" carries out simultaneously the movements of all remaining pieces in the game, thus becoming the most powerful piece in this new double chess game, only surpassed in importance by the king 10 itself since the king's loss implies losing the game.

The "secretary" is initially placed at the left hand side of the dame or queen 11, in the same column as and facing the "secretary" at the opposite side and may move and take opposite player pieces in all directions, but only one square at a time like the king in the traditional chess game, or it may move and take opposite player pieces in the way the knight does in the traditional chess game.

The new game adopts the form of a double chess game with modifications in the playing characteristics and with pieces having more power, which give shape to a new set of wider variations. This makes creativity easier and improves the possibility of improvising movements, using and prizing the players' analytical and strategic capacities on the basis of the multiple possibilities offered by the higher number of pieces that allow placing up to four rooks, queen and chancellor in the very same file or rank, bishop, queen and chancellor in a crisscross line of the same color, etc., and on the basis of the new deployment layout for pawns with which the opening variations developed up to now are increased in a geometrical progression.

Figure 4:
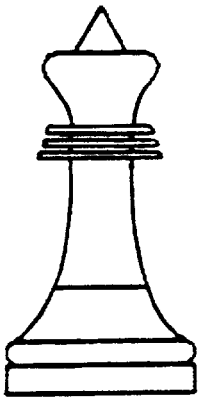
FIG. 4 shows a preferential symbol for a new chess piece called "Chancellor" herein.
Figure 5:
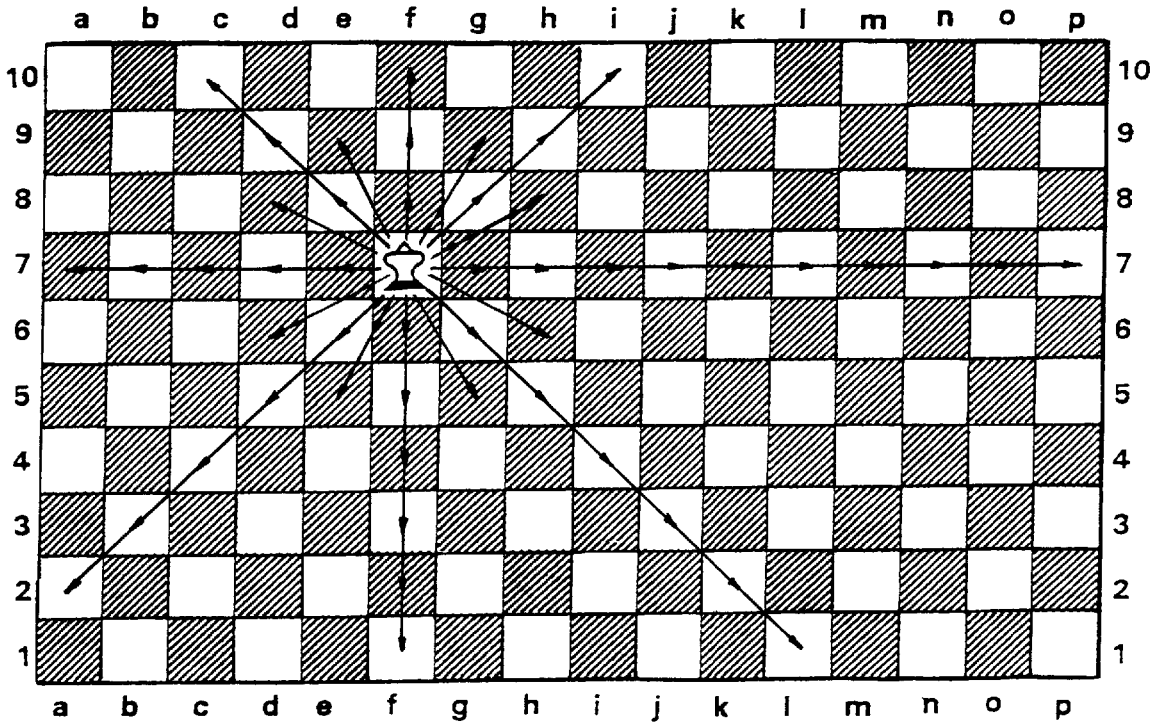
FIG. 5 is an outline illustrating the possible moves on the board of the piece called "Chancellor".

The visual representation of the pieces is maintained to avoid any confusion as to the traditional one, while the new pieces have preferentially been given a symbol which for the "chancellor" 12 may consist of a similar shape to that of the king 10 with a small triangle protruding from the crown's radial center, as represented on FIG. 4. The "secretary" may be represented in a preferred way having a shape similar to that of the dame or queen 11 in the traditional chess, with no crown, as may be seen in FIG. 6.

The usual board 1 with identical white and black squares 2 and 3 layout allows playing the traditional "checkers game", initially placing the pieces in parallel to the board's narrower sides, and making a display of 5 pieces per row. This enables play with a longer depth since the board has a total of 16 available rows, corresponding to the files provided for the double chess game.

Figure 9:
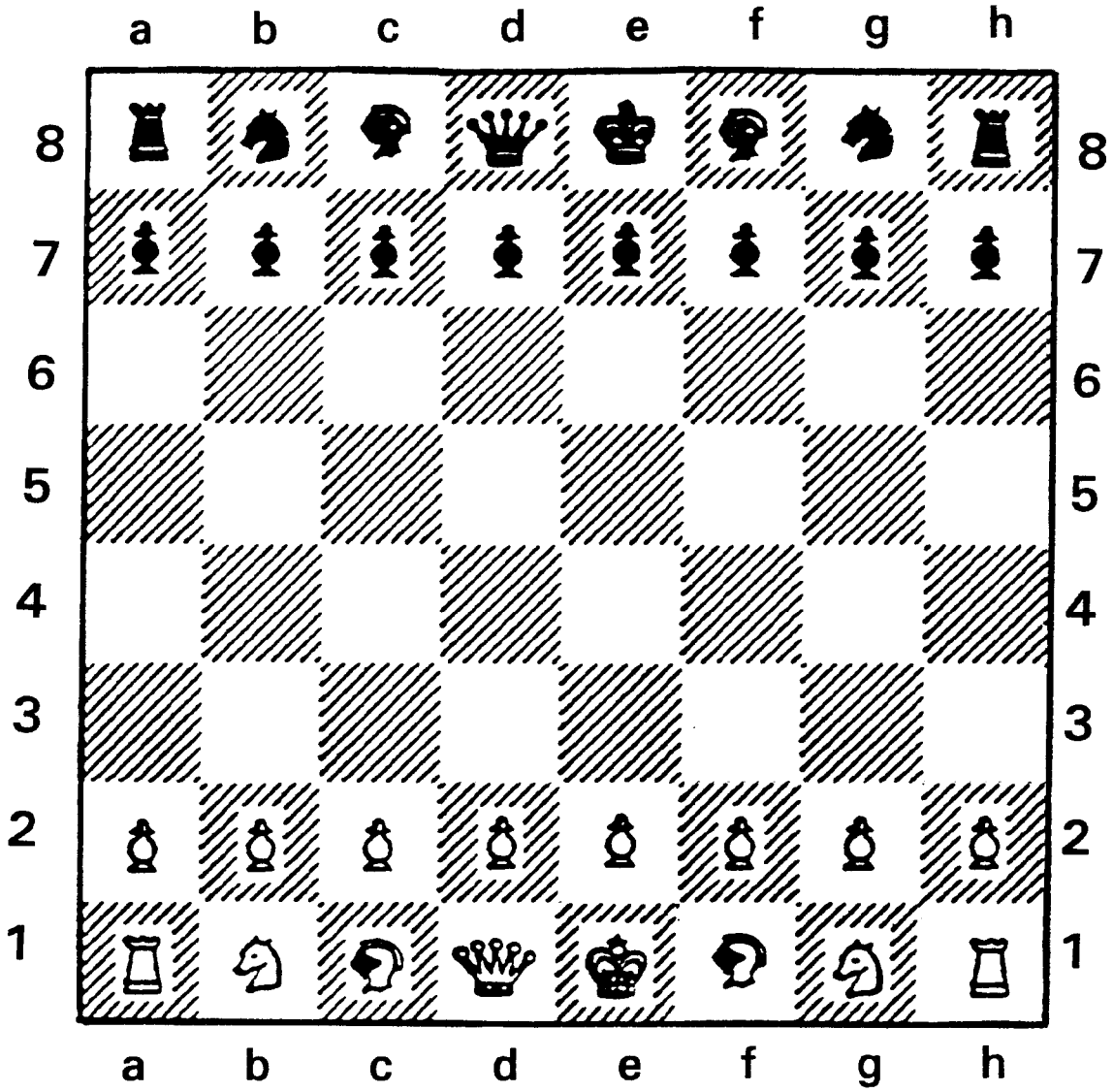
FIG. 9 shows one version of the reverse side of the board of FIG. 1.
Figure 6:
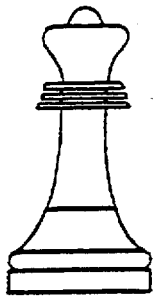
Figure 7:
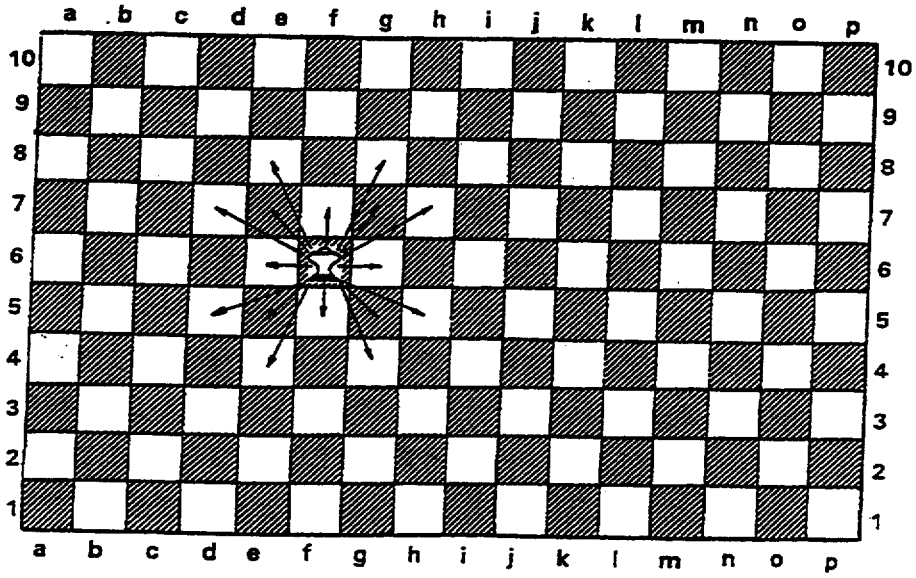

The reverse side of the board 1 can be as shown in FIG. 9, which is a traditional chess board, with 64 squares in 8 ranks having 8 files each. A board with such opposite side displays allows alternatively playing both the new and the traditional chess games, since the traditional chess pieces are included among the pieces incorporated in the new double chess game.

The invention is easy to produce starting from duly die-cast tridimensional models forming an integral game set composed of board, chess pieces and game rules, entering it into the didactical and table games field.

Any modification in the name or representation of chess pieces, their shapes, dimensions, colors, textures or presentations which do not affect the characteristic of these games are included.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A double chess enlightening game comprising:

a chess board having alternating color squares which are arranged in and alternate along 16 columns and between 8 and 12 rows;

two color sets each of a total of 32 game pieces, each set including 16 pawns, 4 rooks, 4 bishops, 4 knights, 1 queen, 1 king and 1 each of two other pieces, each other piece having an appearance different from all of the other game pieces.

2. The game of claim 1 where the two other pieces are respectively a chancellor having an appearance similar to that of the king but different therefrom and a secretary having an appearance similar to that of the queen but different therefrom.

3. The game of claim 1, wherein the squares on the board are in 10 rows.

4. A method of playing a double chess game 1, wherein the game comprises;

a chess board having alternating color squares which are arranged in and alternate along 16 columns and between 8 and 12 rows;

two color sets each of a total of 32 chess pieces, each set including 16 pawns, 4 rooks, 4 bishops, 4 knights, 1 queen, 1 king and two other pieces comprising 1 chancellor and 1 secretary, each of the chancellor and the secretary having an appearance different from all of the other chess pieces and from each other;

at start of play, arranging the 32 pieces of each set in the two rows at each respective opposite side of the board, with the pawns in the second row from each side and the chancellor and the secretary pieces in the final row at each side, the king and the queen pieces of one set being at the center columns in their respective final row and next to each other, and the king and queen pieces of the other set being in the same respective columns in their respective opposite final row;

moving the chess pieces according to their usual permitted movements in a chess game; moving the chancellor and the secretary pieces in respective ways different from all of the other game pieces.

5. The method of claim 4, wherein the chancellor piece of each set is placed at the right hand side of the respective king and is movable during the game to take opposing pieces of the other set in every straight line direction across the board and at any distance and also to move as a traditional knight piece and to take pieces of the other set as would a traditional knight piece.

6. The method of claim 5, wherein the secretary piece of each set is placed at the left hand side of the queen of each set and the secretary piece may move and take opposing pieces in all directions but may advance only one square at a time, as the king piece in a traditional game, or may move and to take pieces jumping as the knight piece does in the traditional game.

7. The method of claim 4, wherein the secretary piece of each set is placed at the left hand side of the queen of each set and the secretary piece may move and take opposing pieces in all directions but may advance only one square at a time, as the king piece in a traditional game, or may move and to take pieces jumping as the knight piece does in the traditional game.

8. The method of claim 7, wherein the pieces are movable on the board following conventional chess game rules, and the pawns of each set are initially movable one, two or three squares forward as the player selects;

the 4 rooks in the respective row are dispersed toward each side of the king and queen combination in the respective row;

the castling move is made with either the first encountered or the second encountered rook at each side in the respective row, in one move or in two moves and even if the intermediate squares are being threatened by opposing other set pieces.

9. The method of claim 4, wherein the pieces are movable on the board following conventional chess game rules, and the pawns of each set are initially movable one, two or three squares forward as the player selects.

10. The method of claim 4, wherein the 4 rooks in the respective row are dispersed toward each side of the king and queen combination in the respective row;

and the castling move is made with either the first encountered or the second encountered rook at each side in one move or in two moves and even if the intermediate squares are being threatened by opposing pieces of the other set.

11. The method of claim 4, wherein one of the other pieces is at the right hand side of the king piece in the respective row of each set and the other of the other pieces is at the left hand side of the queen piece of the set in the respective row.

12. The method of claim 4, wherein the chancellor has an appearance similar to that of the king but different therefrom and the secretary has an appearance similar to that of the a queen but different therefrom.

* * * * *

UNITED STATES PATENT AND TRADEMARK OFFICE

CERTIFICATE OF CORRECTION

PATENT NO. : 5,954,333

DATED : September 21, 1999

INVENTOR(S) : Viches GUERRA

Figure 6:
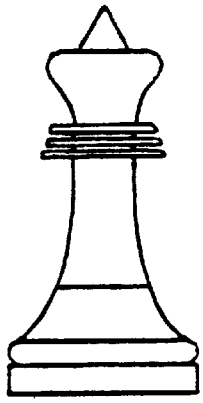
FIG. 6 shows a preferential symbol for a new chess piece called "Secretary" herein.
Figure 7:
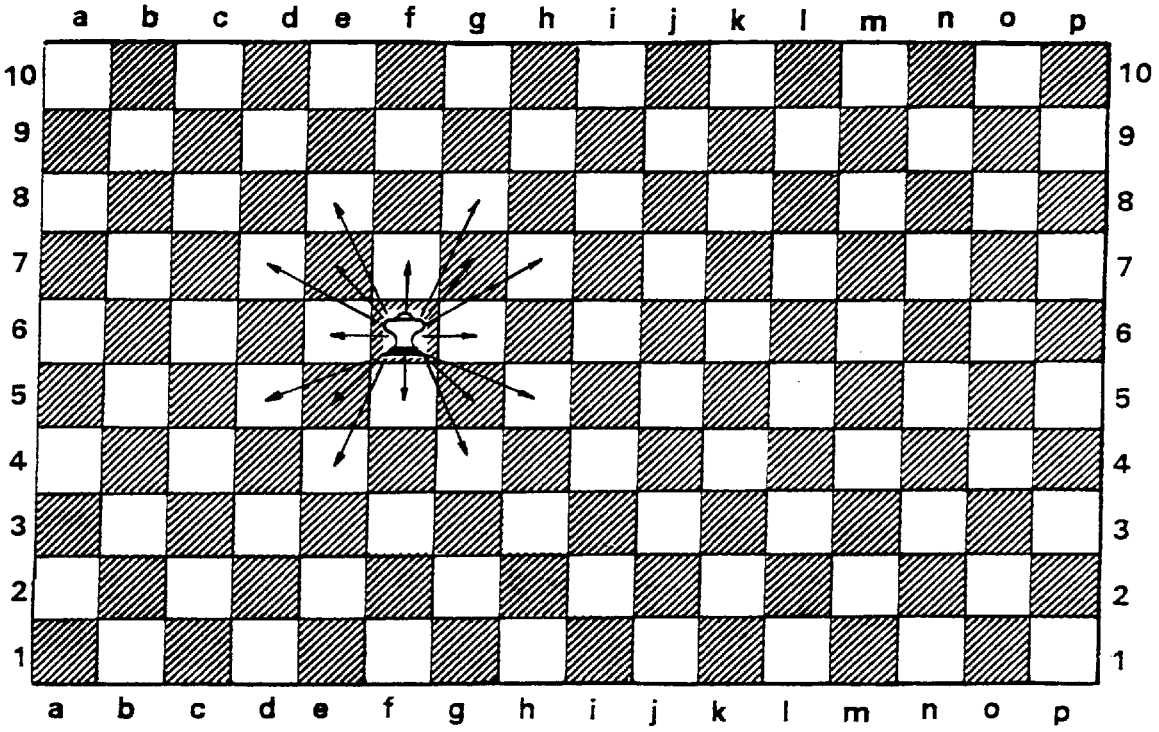
FIG. 7 is an outline of possible moves on the board of the piece called "Secretary".
Figure 8:
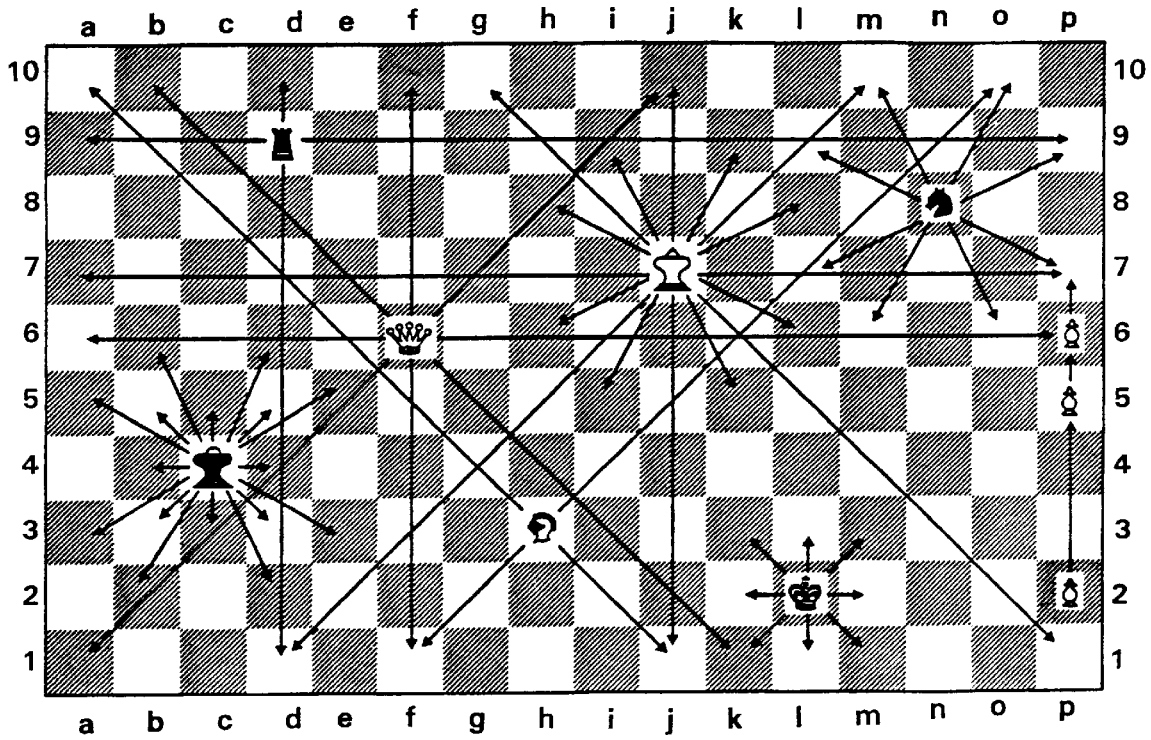
FIG. 8 is an outline depicting possible moves of different chess pieces on the board.

It is certified that error appears in the above-identified patent and that said Letters Patent is hereby corrected as shown below:

In the drawings:

The Drawing Sheet, consisting of Fig. 6, should be deleted to be replaced with the Drawing Sheet consisting of Fig. 6, as shown on the attached page.

Signed and Sealed this

Twenty-fifth Day of April, 2000

*Attest:*

Q. TODD DICKINSON

*Attesting Officer*

*Director of Patents and Trademarks*